US005819486A

United States Patent [19]

Goodings

[11] Patent Number: 5,819,486

[45] Date of Patent: Oct. 13, 1998

[54] APPARATUS AND METHOD OF INSTALLATION OF A COMPOSITE BUILDING PANEL

[75] Inventor: Peter J. Goodings, North York, Canada

[73] Assignee: 1140595 Ontario, Inc., Ontario, Canada

[21] Appl. No.: 551,202

[22] Filed: Oct. 31, 1995

[51] Int. Cl.[6] ..... E04B 2/88

[52] U.S. Cl. ..... 52/235; 52/510

[58] Field of Search ..... 52/235, 508, 510, 52/512

[56] References Cited

U.S. PATENT DOCUMENTS

| | | | |
|---|---|---|---|
| 90,924 | 1/1869 | Fisher . | |
| 1,966,041 | 7/1934 | Nelson . | |
| 2,120,195 | 6/1938 | Valenti . | |
| 3,248,838 | 5/1966 | Stark | 52/508 |
| 3,303,620 | 2/1967 | Dawson . | |
| 3,553,918 | 1/1971 | Dauson | 52/235 |
| 3,562,995 | 2/1971 | Wickert | 52/235 X |
| 3,769,775 | 11/1973 | Brzezinski | 52/235 X |
| 5,063,718 | 11/1991 | Nonis | 52/235 |
| 5,094,051 | 3/1992 | Miller | 52/235 |
| 5,191,745 | 3/1993 | Story | 52/510 X |
| 5,220,758 | 6/1993 | Stommel | 52/235 |
| 5,452,552 | 9/1995 | Ting | 52/235 |

FOREIGN PATENT DOCUMENTS

| | | |
|---|---|---|
| 385572 | 4/1939 | Canada . |
| 686819 | 5/1964 | Canada . |
| 2022601 | 8/1990 | Canada . |
| 2072413 | 6/1992 | Canada . |

*Primary Examiner*—Carl D. Freidman
*Assistant Examiner*—Beth Aubrey
*Attorney, Agent, or Firm*—McAulay Fisher Nissen Goldberg & Kiel, LLP

[57] ABSTRACT

A new and useful anchor for use in the installation of a composite building panel. The anchor comprises a vertically upstanding wall mounting face and a spacer extending normal to the wall mounting face. Spaced outwardly from the wall mounting face by the spacer there is provided a first longitudinally extending flange-receiving groove opening in a first vertical direction. Adjacently deposed to the first flange-receiving groove with a common middle wall there is provided a second longitudinally extending flange-receiving groove opening in an opposite vertical direction. Fasteners mount the anchor means to the wall.

18 Claims, 2 Drawing Sheets

APPARATUS AND METHOD OF INSTALLATION OF A COMPOSITE BUILDING PANEL

FIELD OF THE INVENTION

This application relates to an apparatus and method for use in the installation of composite building panels.

BACKGROUND OF THE INVENTION

Builders and home owners are frequently looking for just the right exterior surface for their buildings. Currently, however, the choice of finishing systems available is fairly restrictive. Two of the more popular choices in terms of appearance are brick and stone. However, natural stone is simply too expensive for use on anything other than a small number of applications where the market can bear the cost. Even brick has become too expensive for the low and middle class housing market. As such, builders typically look to cheaper vinyl and aluminum siding as the alternative. However, those materials are rarely considered as pleasing exterior finishes. Therefore, there exists a demand for an affordable alternative product, one which is aesthetically pleasing, requires little maintenance and, most of all, is easy to install, either during the building stage or as a renovation project.

In its co-pending Canadian Patent Application Serial No. 2,107,847, applicant describes a composite building panel which meets this demand. The present invention is related to an anchor for use in the installation of a composite building panel such as that described in applicant's co-pending Canadian patent application and to a method of using that anchor in the installation of such a panel.

The prior art describes apparatus and methods of installing a variety of sheet wall panelling, building tiles and concrete slabs using discrete clips and adhesives. Reference is made for example to U.S. Pat. No. 2,120,195, of Valenti, issued Jun. 7, 1938, Canadian Patent No. 90,924of Fisher issued Jan. 12, 1905, Canadian Patent No. 686,819 of Medow, issued May 19, 1964, Canadian Patent No. 462,686 of Wardle, issued Apr. 19, 1939 and Canadian laid-open Patent Application Serial No. 2,022,601 of Francis, filed, Aug. 2, 1990. However, none of these references is directed towards an apparatus and method capable of use in the installation of a composite building panel similar to that of applicant's co-pending Canadian patent application.

SUMMARY OF THE INVENTION

In one aspect of the invention there is provided an anchor for use in the installation of a composite building panel. The anchor comprises a vertically upstanding wall mounting face and a spacer secured to and extending outwardly from the wall mounting face. Spaced remote from the wall mounting face by the spacer there is provided a first longitudinally extending flange-receiving groove opening in a first vertical direction and adjacently deposed to the first flange-receiving groove with a common middle wall there is provided a second longitudinally extending flange-receiving groove opening in an opposite vertical direction. Fasteners mount the anchor means to the wall.

In another aspect of the invention, there is provided at least one pair of clips secured within the panel. Each of the clips comprise three strips secured together in step-like fashion. A first of the strips is oriented to be completely embedded within a panel, a second of the strips is partly embedded within said panel and extends beyond a back face of said panel and a third of the strips being an anchor-engaging strip sits outside the panel, an end of the third strip constructed so as to engage within the first or second groove of the anchor.

In another aspect of the invention, there is provided at least one first clip secured within a lower portion of the panel such that the anchor-engaging strip of the first clip projects beyond a bottom edge of the back face for mating relation with the first flange-receiving groove of an anchor. There is also provided at least one second clip secured within an upper portion of the panel such that the anchor-engaging strip of the second clip projects beyond a top edge of the back face for mating relation with the second flange-receiving groove of an anchor.

BRIEF DESCRIPTION OF THE DRAWINGS

These and other advantages of the invention will become apparent upon reading the following detailed description and upon referring to the drawings in which.

Figure 1:
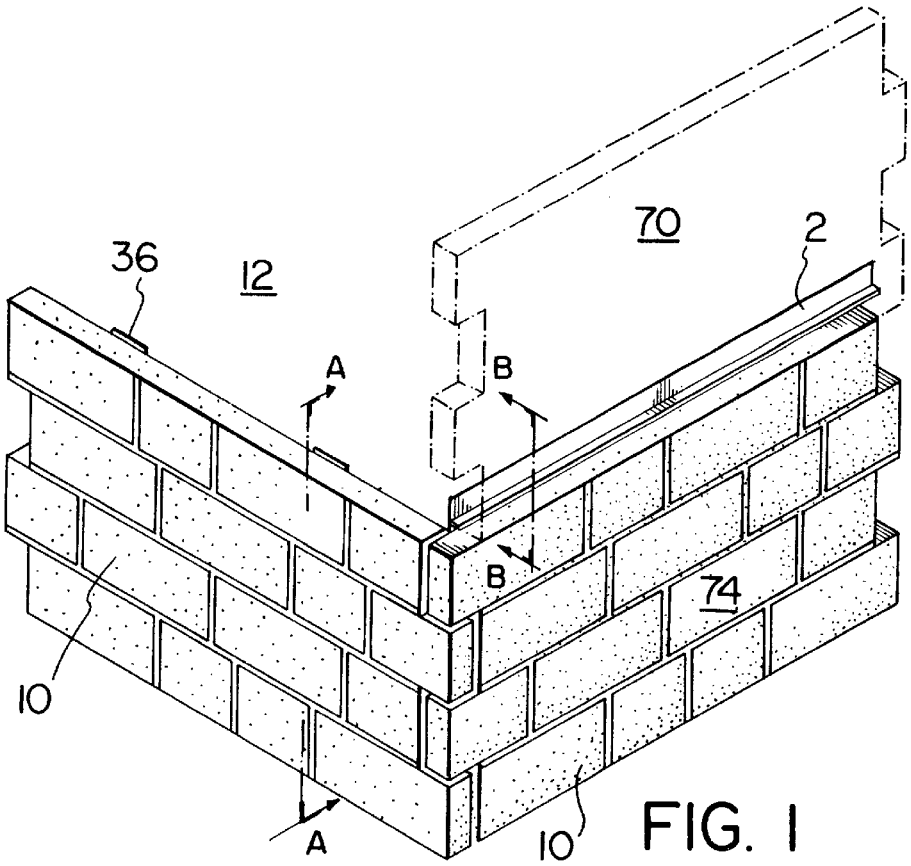
FIG. 1. is a perspective view of a wall incorporating anchors, clips and composite building panels in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, FIG. 1 illustrates an anchor 2 for use in the installation of a composite building panel 10, such as mounting to an existing wall 12. The panel 10 is preferably of the type described in applicant's co-pending Canadian Patent Application Serial No. 2,107,847.

Figure 2:
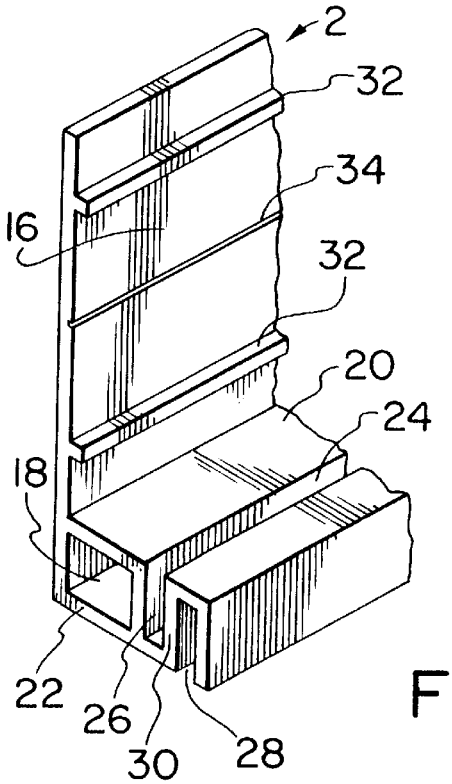
FIG. 2 is a partially cut away perspective view of the anchor of the present invention.

The anchor 2 is of one-piece construction and comprises a vertically upstanding wall mounting face 16 which is presented to the wall 12 in use. Secured to and extending outwardly and substantially normal from the wall mounting face 16 there is spacer 18. As shown in FIG. 2, the spacer 18 preferably comprises a pair of vertically spaced parallel faces 20 and 22 extending normal from the wall mounting face 16 and joined by longitudinal face 24. There is thus created a box structure which provides added strength and stability to the spacer 18 in use.

The spacer 18 spaces a first longitudinally extending flange-receiving groove 26 remote from the wall mounting face 16, which groove 26 opens in a first vertical direction and is substantially parallel to the wall mounting face 16. Adjacent the first flange-receiving groove 26 there is a second, longitudinally extending flange-receiving groove 28 which opens in an opposite vertical direction from the first flange-receiving groove 26. The second flange-receiving groove 28 is adjacently deposed to the first flange-receiving groove 26 with a common middle wall 30.

In an aspect of the invention, the wall mounting face 16 includes at least one laterally extending rib 32 which provides additional stiffness to the wall mounting face 16 in operation. Further, there may also be provided a laterally extending groove 34 within the wall mounting face 16. The groove 34 may be used as a drill guide to assist in orienting a drill bit or self-drilling fastener tips (not illustrated) during installation of the wall mounting face 16 to the wall 12.

Figure 3:
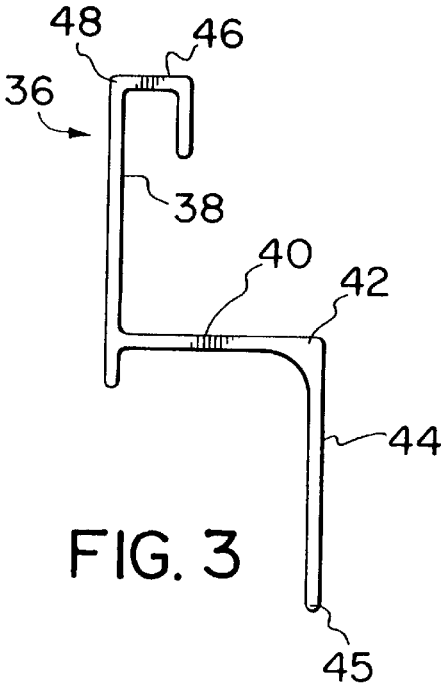
FIG. 3 is a side plan view of the clip to be seated in the anchor in accordance with the present invention.

In another aspect of the invention, at least one clip 36 is secured or embedded within the panel 10 for mating engagement with the anchor 2. As most clearly illustrated in FIG. 3, the clip 36 comprises three strips secured together in a step-like fashion. A first 38 of the strips is oriented to be completely embedded within the panel 10, a second 40 of the strips is oriented to be partly embedded within the panel 10 is perpendicular to the first strip 38 with an extremity 42 extending beyond the panel 10. A third 44 of the strips being an anchor-engaging strip is perpendicular to the second strip 40 and sits outside the panel 10 with an end 45 constructed so as to engage within the first or second groove in the anchor. The clip 36 preferably also comprises an upper lip 46 located at a top portion 48 of the first strip 38 to provide increased holding strength of and stability of the clip 36 within the panel 10.

Figure 4:
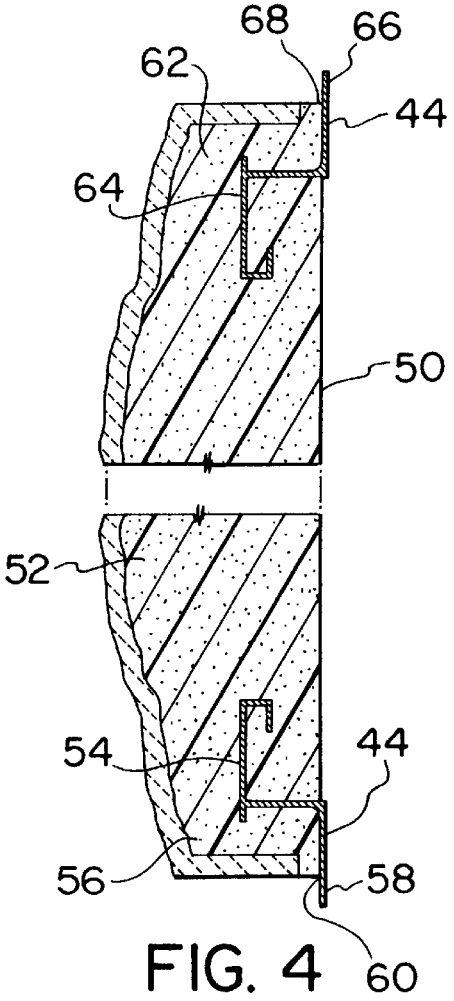
FIG. 4 is a cross-sectional view of the clips within a panel taken along line A—A of FIG. 1.

With reference to FIG. 4, when embedded within the panel 10, the anchor-engaging strip 44 is preferably adjacent with a back face 50 of panel 10. The remainder of the clip 36 is preferably embedded within the foam 52 of panel 10.

In another embodiment of the invention, as best illustrated in FIG. 4, there is at least one first clip 54 secured or embedded within the panel 10 at a lower portion 56 thereof. In that configuration, the projection 58 of anchor-engaging strip 44 of the first clip 54 projects beyond a bottom edge 60 of the back face 50 of panel 10. Within an upper portion 62 of panel 10, there is secured or embedded at least one second clip 64 such that the projection 66 of anchor-engaging strip 44 of the second clip 64 projects beyond a top edge 68 of the back face 50 of panel 10.

Figure 5:
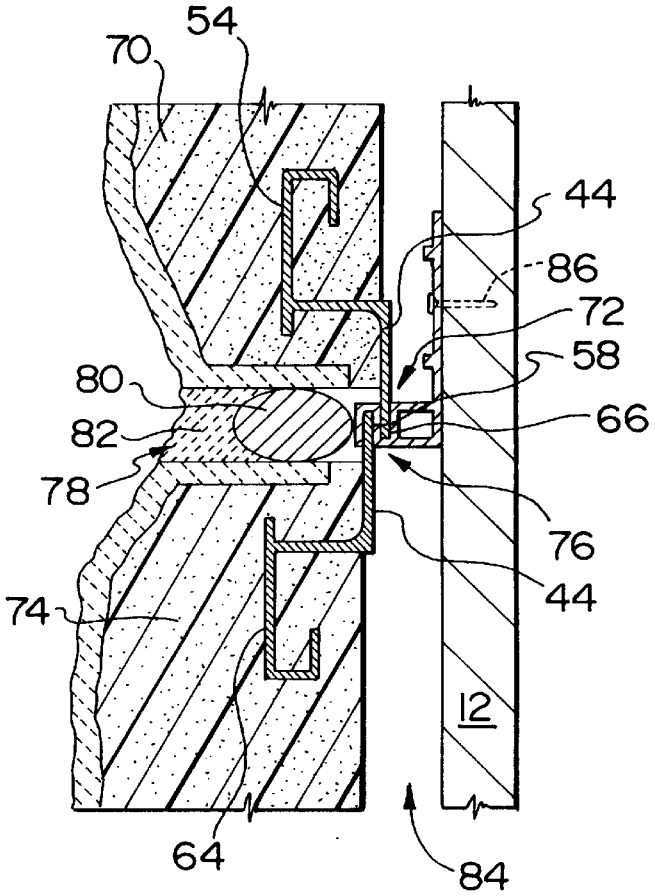
FIG. 5 is a cross-sectional view of the invention in use taken along line B—B of FIG. 1.

As most clearly illustrated in FIG. 5, the projection 58 of anchor-engaging strip 44 of first clip 54 secured within panel 70 is in mating relation with the first flange-receiving groove 26 of anchor 2, as shown at 72. The projection 66 of anchor-engaging strip 44 of second clip 64 secured within panel 74 is in mating relation with the second flange-receiving groove 28 of anchor 2, as shown at 76.

In use, as illustrated in FIG. 5, the anchor 2 creates a vertical spacing 78 between panel 70 and panel 74. The vertical spacing 78 is typically about 0.5 inches in height. It may be filled with a foam rope 80 and/or mortar 82 or any other insulating material that provides the necessary insulation and water barrier properties.

The design of the anchor 2 also produces a horizontal spacing 84 between the panel 10 and the wall 12. This spacing 84 allows for the necessary breathing space between the panel 10 and the wall 12 as well as water evacuation and condensation control as required by building codes and regulations.

The method of using anchors 2 to install a plurality of panels 10 is to fasten a first anchor 2 at a first position along the wall 12 with a plurality of fasteners 86 spaced evenly along the length of the anchor 2. A plurality of panels 74 may then be secured to the first anchor means and installed in side-by-side relation by placing the first projection 58 of anchor-engaging strip 44 in mating relation with the first flange-receiving groove 26 of the anchor 2. There is thus created a first row of panels. A second anchor 2 is then fastened to the wall 12 by a plurality of fasteners 86 such that the second projection 66 of anchor-engaging strips 44 of panels 70 of the first row is in mating relation with the second flange-receiving groove 28 of the second anchor 2. A plurality of panels 74 may then be secured to the second anchor 2 and secured in place by placing the first projection 58 of anchor-engaging strip 44 of panel 74 in mating relation with the first flange-receiving groove 26 of the second anchor 2. There is thus created a second row of panels. This process is then repeated as required to completely cover the building exterior, as desired by the user. Once complete, the vertical spacings 78 between the rows of panels may be filled in with the desired material.

Thus, it is apparent that there has been provided in accordance with the invention an apparatus and method for use in the installation of a composite building panel that fully satisfies the objects, aims and advantages set forth above. While the invention has been described in conjunction with example embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property of privilege is claimed are defined as follows:

1. A one-piece integral extruded anchor for use in the installation of composite building panel, said anchor comprising:

a vertically upstanding wall mounting face;

a spacer extending outwardly from said vertically upstanding wall mounting face;

a first longitudinally extending flange-receiving groove spaced adjacent said spacer remote from said wall mounting face, said first groove opening in a first vertical direction in a vertical plane parallel to said wall mounting; and a second longitudinally extending flange-receiving groove disposed in a vertical plane parallel to and spaced from said plane of said first groove and opening in an opposite vertical direction to said first groove, said second groove adjacently disposed to said first groove with a common middle wall.

2. The anchor of claim 1 wherein said spacer extends horizontally outwardly from a bottom of said wall mounting face.

3. The anchor of claim 1 including fasteners to mount said anchor to a wall.

4. The anchor of claim 1 wherein said vertically upstanding wall mounting face includes at least one laterally extending rib.

5. The anchor of claim 1 wherein said vertically upstanding wall mounting face includes at least one laterally extending groove.

6. The anchor of claim 1 wherein said spacer comprises a pair of spaced substantially parallel faces secured to said wall mounting face.

7. The anchor of claim 1 in combination with at least one clip comprising three elongated strips secured together in step-like fashion.

8. The anchor and clip combination of claim 7 wherein a first of said strips is oriented to be completely embedded within a panel having an upper portion and a lower portion, a second of said strips is perpendicular to said first strip and is to be partly embedded within the panel to extend beyond a back face of the panel and a third of said strips being perpendicular to said second strip to sit outside the panel and to engage within said first or second groove of said anchor.

9. The anchor and clip combination of claim 8 wherein there is a downward lip at a top portion of said first strip.

10. The anchor and clip combination of claim 8 wherein said third of said strip is in mating engagement with said first or second flange-receiving groove of said anchor.

11. The anchor and clip combination of claim 8 wherein there is at least one first clip adapted to be secured within said lower portion of panel such that said third of said strips projects longitudinally beyond a bottom edge of said back face in anchor engageable fashion and at least one second clip adapted to be secured within said upper portion of the panel such that said third said of said strips projects longitudinally beyond a top edge of said back face in anchor engageable fashion.

12. The anchor and clip combination of claim 11 wherein said third of said strips of said at least one first clip mates with said first flange-receiving groove and said third of said strips of said at least one second clip mates with said second flange-receiving groove.

13. For use in the installation of composite building panels;

(a) an anchor of integral extruded construction comprising:

a vertically upstanding wall mounting face including at least one laterally extending rib and at least one laterally extending groove;

a spacer extending outwardly from said vertically upstanding wall mounting face said spacer comprising a pair of spaced substantially parallel faces;

a first longitudinally extending flange-receiving groove adjacent said spacer remote from the wall mounting face, said first groove opening in a first vertical direction parallel to said wall mounting face;

a second longitudinally extending flange-receiving groove disposed in a vertical plane parallel to said first groove and opening in an opposite vertical direction to said first groove, said second groove adjacently disposed to said first groove with a common middle vertical wall;

(b) at least one pair of first and second clips for securement within a panel, said first and second clips each comprising three strips secured together in step-like fashion, a first of said strips oriented to be completely embedded within the panel and including a downward lip at a top portion of said strip, a second of said strips perpendicular to said first strip and oriented to be partly embedded within the panel and extending beyond a back face of the panel and a third of said strips being perpendicular to said second strip oriented to sit outside the panel and having an end constricted to engage within said first or second groove of said anchor, said first clip adapted to be secured within a lower portion of said back face of the panel so that said third of said strips of said first clip projects longitudinally beyond a bottom edge of said back face for mating engagement with said first flange-receiving groove of said anchor and said second clip adapted to be secured within an upper portion of said back face so that said third of said strips of said second clip projects longitudinally beyond a top edge of said back face for mating engagement with said second flange-receiving groove of said anchor; and (c) fasteners to mount said anchor to a wall.

14. A method of installing a composite building panel comprising the steps of:

mounting an anchor to a wall, said anchor having a vertically upstanding wall mounting face, a spacer secured to and extending outwardly from said vertically upstanding wall mounting face, a first longitudinally extending flange-receiving groove adjacent said spacer remote from said wall mounting face, said first groove opening in a first vertical direction, a second longitudinally extending flange-receiving groove opening in an opposite vertical direction, said second groove adjacently deposed to said first groove with a common middle wall and fasteners to mount said anchor to said wall;

securing to said anchor a panel having at least one pair of clips secured within said panel, each of said clips comprising three strips secured together in step-like fashion, a first of said strips oriented to be completely embedded within a panel and including a downward lip at a top portion of said first strip, a second of said strips oriented to be partly embedded within said panel and extending beyond a back face of said panel and a third of said strips being an anchor-engaging strip oriented to sit outside said panel and having an end constructed so as to engage within said first or second groove, by placing said anchor-engaging strip of said clips in mating relation with said first or second flange-receiving groove of said anchor.

15. The method of claim 14 including the steps of mounting a plurality of anchors to the wall.

16. The method of claim 15 including the steps of:

mounting a first anchor to the wall;

mounting a plurality of first panels to said first anchor by placing said flanges of a first of said clips of said first panel in mating relation with said first flange-receiving groove of said first anchor;

mounting a second anchor to the wall by placing said second flange-receiving groove in mating relation with said anchor-engaging strips of a second of said clips of said first panel;

mounting a plurality of second panels to said second anchor in longitudinally spaced relation to said plurality of first panels by placing said anchor-engaging strip of said first clip of said second panel in mating relation with said first flange-receiving groove of said second anchor;

filling the longitudinal space between said plurality of first panels and said plurality of second panels by inserting at least one of foam rope or mortar;

repeating the steps as required to cover the wall with said panels.

17. In combination a building panel having lower and upper ends and a face extending between the ends;

at least one clip secured in the lower end of said panel, said clip having a first strip completely embedded in said panel, a second strip perpendicular to said first strip and extending to the face of said panel and a third strip perpendicular to said second strip to extend along said panel; and a one-piece extruded anchor for securing said panel to a wall, said anchor having a vertically disposed wall mounting face, a spacer extending outwardly of said wall mounting face, a first vertically disposed groove parallel to said wall mounting face and receiving said third strip of said clip, a second vertically disposed groove parallel to said first groove and opening in a vertical direction opposite said first groove and a common vertical wall between said grooves.

18. The combination as set forth in claim 17 further comprising a second building panel having an upper end; and at least a second clip secured in the upper end of said second panel, said second clip having a first strip embedded in said second panel, a second strip perpendicular to said first strip of said second clip, and a third strip perpendicular to said second strip of said second clip and received in said second groove of said anchor.

* * * * *

UNITED STATES PATENT AND TRADEMARK OFFICE
CERTIFICATE OF CORRECTION

PATENT NO. : 5,819,486

ISSUED : October 13, 1998

INVENTOR(S) : Peter J. Goodings

It is certified that this error appears in the above-identified patent and that said Letters Patent is hereby corrected as shown below:

Column 4, line 41, after "mounting" insert -face-

Column 5, line 17, cancel "said" (second occurrence)

Signed and Sealed this

Nineteenth Day of January, 1999

*Attest:*

*Attesting Officer*

*Acting Commissioner of Patents and Trademarks*